US008353990B2

(12) United States Patent
Gassen et al.

(10) Patent No.: US 8,353,990 B2
(45) Date of Patent: Jan. 15, 2013

(54) PROCESS FOR CHEMICALLY DECONTAMINATING RADIOACTIVELY CONTAMINATED SURFACES OF A NUCLEAR PLANT COOLING SYSTEM USING AN ORGANIC ACID FOLLOWED BY AN ANIONIC SURFACTANT

(75) Inventors: Rainer Gassen, Fuerth (DE); Luis Sempere Belda, Erlangen (DE); Werner Schweighofer, Erlangen (DE); Bertram Zeiler, Bischberg (DE)

(73) Assignee: Areva NP GmbH, Erlangen (DE)

( * ) Notice: Subject to any disclaimer, the term of this patent is extended or adjusted under 35 U.S.C. 154(b) by 0 days.

(21) Appl. No.: 13/211,350

(22) Filed: Aug. 17, 2011

(65) Prior Publication Data

US 2011/0303238 A1 Dec. 15, 2011

Related U.S. Application Data

(63) Continuation of application No. PCT/EP2010/051957, filed on Feb. 17, 2010.

(30) Foreign Application Priority Data

Feb. 18, 2009 (DE) ..... 10 2009 009 441
Apr. 28, 2009 (DE) ..... 10 2009 002 681

(51) Int. Cl.
*C23G 1/02* (2006.01)
*C11D 3/20* (2006.01)

(52) U.S. Cl. ..... 134/2; 134/3; 134/22.14; 134/22.19; 510/110; 510/245; 510/247

(58) Field of Classification Search ..... 134/2, 3, 134/22.13, 22.14, 22.16, 22.17, 22.19; 510/109, 510/110, 184, 195, 245, 247, 363, 424, 426, 510/432, 434, 477; 588/1
See application file for complete search history.

(56) References Cited

U.S. PATENT DOCUMENTS 3,793,221 A * 2/1974 Otrhalek et al. ..... 510/242
4,729,855 A * 3/1988 Murray et al. ..... 134/2
5,037,482 A 8/1991 Kukanskis et al.
(Continued)

FOREIGN PATENT DOCUMENTS

DE 3339048 A1 5/1985
(Continued)

OTHER PUBLICATIONS

International Search Report dated Jul. 29, 2010. Written Opinion.

*Primary Examiner* — Saeed T Chaudhry
(74) *Attorney, Agent, or Firm* — Laurence A. Greenberg; Werner H. Stemer; Ralph E. Locher

(57) ABSTRACT

A process is provided for chemically decontaminating the surface of a metallic component. In a first treatment step, an oxide layer formed on the component by corrosion of the material of the component is detached from the surface of the component with a first aqueous treatment solution containing an organic decontamination acid. In a subsequent second treatment step, the surface which is at least partially freed of the oxide layer is treated with an aqueous solution containing an active component for removing particles which adhere to the surface. The active component is formed of at least one anionic surfactant from the group including sulphonic acids, phosphonic acids, carboxylic acids and salts of those acids.

21 Claims, 1 Drawing Sheet

U.S. PATENT DOCUMENTS

| | | | | |
|---|---|---|---|---|
| 5,523,513 | A * | 6/1996 | Milner | 588/1 |
| 5,752,206 | A | 5/1998 | Frink et al. | |
| 5,814,204 | A * | 9/1998 | D'Muhala | 205/705 |
| 6,423,148 | B1 * | 7/2002 | Aoki | 510/175 |
| 6,444,276 | B2 | 9/2002 | Bertholdt | |
| 6,525,237 | B1 | 2/2003 | Purdon et al. | |
| 6,730,644 | B1 * | 5/2004 | Ishikawa et al. | 510/175 |
| 2001/0031320 | A1 | 10/2001 | Bertholdt | |
| 2003/0172959 | A1 | 9/2003 | Martin | |
| 2010/0116288 | A1 | 5/2010 | Bertholdt et al. | |

FOREIGN PATENT DOCUMENTS

| | | | |
|---|---|---|---|
| DE | 9420866 | U1 | 3/1995 |
| DE | 19851852 | A1 | 5/2000 |
| DE | 60000508 | T2 | 1/2003 |
| DE | 102004047572 | A1 | 4/2006 |
| DE | 102007038947 | A1 | 2/2009 |
| DE | 102007052206 | A1 | 5/2009 |
| EP | 0442197 | A2 | 8/1991 |
| JP | 5148670 | A | 6/1993 |
| WO | 2006034787 | A1 | 4/2006 |
| WO | 2009056447 | A1 | 5/2009 |

* cited by examiner

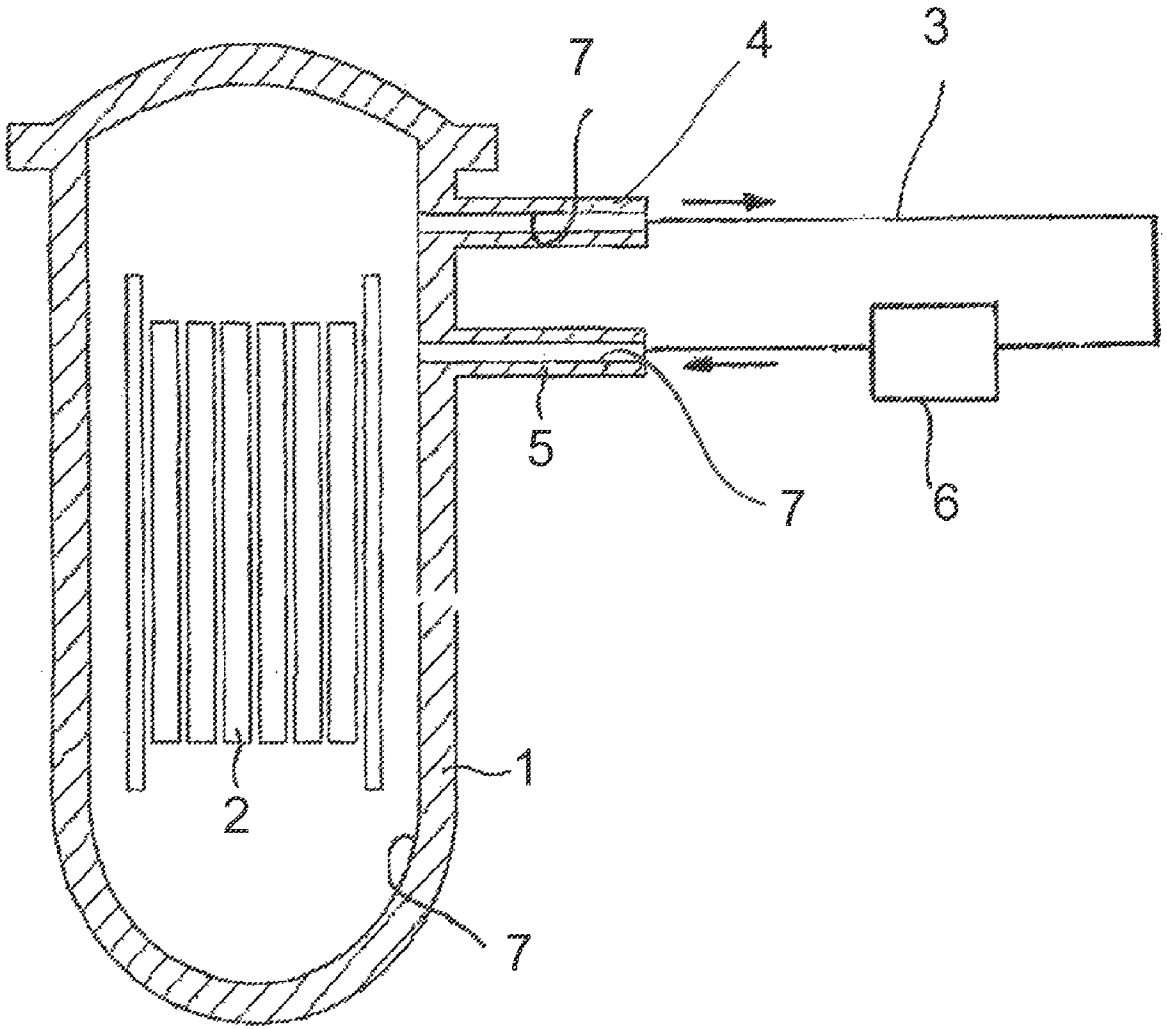
3
4
7
7
6
5
1
7
2

PROCESS FOR CHEMICALLY DECONTAMINATING RADIOACTIVELY CONTAMINATED SURFACES OF A NUCLEAR PLANT COOLING SYSTEM USING AN ORGANIC ACID FOLLOWED BY AN ANIONIC SURFACTANT

CROSS-REFERENCE TO RELATED APPLICATION

This is a continuation, under 35 U.S.C. §120, of copending International Application No. PCT/EP2010/051957, filed Feb. 17, 2010, which designated the United States; this application also claims the priority, under 35 U.S.C. §119, of German Patent Applications DE 10 2009 009 441.5, filed Feb. 18, 2009, and DE 10 2009 002 681.9, filed Apr. 28, 2009; the prior applications are herewith incorporated by reference in their entirety.

BACKGROUND OF THE INVENTION

Field of the Invention

The invention relates to a process for decontaminating radioactively contaminated surfaces of nuclear facilities. During power-generating operation of a nuclear power plant, to which reference is made hereinbelow by way of example, surfaces of components of the coolant system come into contact with water at up to about 350° C. as a coolant, which to a certain degree oxidizes even CrNi steels and Ni alloys which are classified as corrosion-free. An oxide layer, which includes oxygen ions and metal ions, forms on the component surfaces.

During reactor operation, metal ions from the oxide layer enter into the cooling water in dissolved form or as a constituent of oxide particles, and are transported thereby to the reactor pressure vessel in which fuel assemblies are present. The nuclear reactions proceeding in the fuel assemblies give rise to neutron radiation which converts some of the metal ions to radioactive elements. For example, the nickel of the above-mentioned materials forms radioactive cobalt-58. The nuclear reactions which proceed in the core fuel give rise to alpha-emitting transuranics, for example Am-241, which enter into the coolant as oxides through leaks in the fuel rods which accommodate the core fuel. The radioactive elements are distributed in the primary circuit by the circulating cooling water and are deposited again on the oxide layer of component surfaces, for instance on the surfaces of the pipes of the coolant system, or are incorporated into the oxide layer. With increasing operating time, the amount of the radioactive nuclides deposited and/or incorporated, and accordingly the radioactive radiation in the area of the systems and components of the primary circuit, increases. If the intention is to reduce it, for instance in the case of dismantling of a nuclear power plant, substantially the entire contaminated oxide layer has to be removed through the use of a decontamination measure.

The oxide layer on component surfaces is removed, for example, by contacting the component surfaces with a treatment solution including an organic acid, which is accomplished in the case of a coolant system by filling it with the solution mentioned. The organic acid is one which forms water-soluble complexes with the metal ions present in the oxide layer. In some cases, the alloy of which a component is formed includes chromium. In such a case, an oxide layer present on the component includes sparingly soluble chromium(III) oxides. In order to convert them to a soluble form, the surfaces are treated with a strong oxidizing agent such as potassium permanganate or permanganic acid, before the acid treatment mentioned. That converts the chromium(III) oxides to more readily soluble chromium(VI) oxides. Irrespective of whether an oxidative pretreatment is effected or not, the spent cleaning solution including the constituents of the oxide layer in dissolved form is either concentrated to a residual amount or passed over ion exchangers. In the latter case, the constituents of the oxide layer present in ionic form are retained by the ion exchanger and hence removed from the cleaning solution. The ion exchanger material laden with the ionic constituents, some of them radioactive, and the residue of the cleaning solution remaining in the concentration process, are each sent in suitable form to a temporary or final repository.

Such a decontamination treatment conducted routinely, for instance in the course of maintenance work on the coolant system, covers substantially only nuclides which emit gamma radiation, such as Cr-51 and Co-60. Those nuclides are present for the most part in the form of their oxides, for example incorporated in an oxide layer of a component, and those oxides are dissolved relatively readily by the active substances of conventional decontamination solutions, for example by complexing acids. The oxides of the transuranics, for example Am-241 already mentioned above, are less soluble than the oxides formed from the metals and the radioactive nuclides thereof. Oxide particles which are present at the end of a decontamination treatment, adhere in particular on component surfaces which have already been freed from an oxide layer and are invisible to the naked eye, are therefore enriched with alpha emitters compared to the original oxide layer of the components. The particles in question only loosely adhere on the component surface, in such a way that they can be partly wiped off with a cloth, for instance in the course of a wipe test.

In the course of dismantling of a nuclear power plant, for example, the components of the coolant system should be recycled, or it should in any case be possible to handle them without complex protective measures. The particles in question, which adhere to the component surfaces, can become detached readily and enter into the human body through the respiratory pathway, which can be prevented only by very complex respiratory protection measures. The radioactivity, measured on a component, with regard to gamma and beta radiation and with regard to alpha radiation, therefore has to remain below defined limits in order to ensure that the components are no longer subject to the restrictions of radiation protection.

A problem attendant to virtually any surface decontamination is the further treatment or disposal of the spent decontamination solution including the radioactive constituents of the detached oxide layer. As already mentioned above, one feasible route is to pass a spent decontamination solution over an ion exchanger in order to remove charged constituents present therein.

SUMMARY OF THE INVENTION

It is accordingly an object of the invention to provide a process for decontaminating radioactively contaminated surfaces, which overcomes the hereinafore-mentioned disadvantages of the heretofore-known processes of this general type and which frees a surface of radioactive particles with the aid of an active component present in aqueous solution, specifically in such a way that the particles can be removed from the solution in a simple manner.

With the foregoing and other objects in view there is provided, in accordance with the invention, a process for chemically decontaminating a surface of a metallic component. The process comprises, in a first treatment stage, detaching an oxide layer from a component surface with a first aqueous treatment solution containing an organic decontamination acid, the oxide layer having been formed on the component as a result of corrosion of component material and, in a subsequent, second treatment stage, treating the component surface having been at least partly freed of the oxide layer with a second aqueous treatment solution containing an active component to remove particles adhering on the component surface, the active component being formed of at least one anionic surfactant of the group of sulfonic acids, phosphonic acids, carboxylic acids and salts of these acids.

It has been found that, surprisingly, the surfactants mentioned can firstly detach especially metal oxide particles with high efficiency, in particular from metallic surfaces, and that the particles together with the surfactant adhere on an anion exchanger or a mixed bed ion exchanger, that is a combination of anion and cation exchangers. If, as is the aim, a solution which does not include any further chemical substances apart from at least one surfactant is used, a particularly simple disposal after the performance of the decontamination is ensured, since neither a decomposition of the further substances, for instance with the aid of UV light, nor the removal thereof with the aid of an ion exchanger, which would require an additional amount of ion exchanger resin which has to be disposed of, is required.

The invention is explained in detail below.

The sample material used for the examples and tests which follow originates from deinstalled components of the primary coolant circuit of a German pressurized water reactor. They are cut coupons of niobium-stabilized stainless steel, materials number 1.4551, which have, on their surface, an oxide layer which includes radioactive elements and is typical of components of the coolant system of nuclear power plants. The coupons were pretreated with a customary decontamination process.

The samples were treated on the laboratory scale in borosilicate beakers with a capacity of between 500 ml and 2 l. The samples were suspended in the treatment solution, in hanging devices made from borosilicate glass, 1.4551 stainless steel, ANSI 316 stainless steel, or PTFE. The heating to the test temperature was effected with the aid of electrical hot plates. The temperature was established and kept constant with contact thermometers. The solution was mixed by using magnetic or mechanical stirrers.

The measurement of the radioactivity present on the samples was conducted in a radiochemical laboratory, accredited to DIN EN ISO/IEC 17025:2005 (by the Deutsches Akkreditierungssystem Prüfwesen GmbH, Deutscher Akkreditierungsrat (DAR), Accreditation Certification No. DAP-PL-3500.81).

The number of decimal places was limited for better readability of the results. For example, the complete non-rounded values were used for calculations of decontamination factors.

Representativeness of the measurement of Am-241 for the behavior of the alpha-emitting actinoids Pu, Am, Cm:

The measurement of alpha radiation requires relatively high complexity. In contrast, it is much easier and quicker, and additionally more precise, to determine gamma activity. The activity of the americium isotope 241, which is based on gamma radiation, was therefore detected as an indicator for the behavior of the actinoids or transuranics which emit alpha radiation.

Table 1 compares, by way of example, the evolution of the activity of Am-241 determined through the use of gamma radiation detectors on one of the samples described with the activity of the isotopes Pu-240, Cm-242 and Am-241, detected with alpha radiation detectors in the untreated state (No. 1), after a decontamination with customary decontamination methods (No. 2) and with a decontamination method in which an inventive active component according to the present invention was used in different concentrations (Nos. 3, 4, 5). In order to facilitate a comparison of the removal of activity, in addition to the measurements obtained in Bq/cm$^2$, the percentage values based on the starting amount are also reproduced. In each case, surfactants with one and the same organic radical ($CH_3$—$(CH_2)_{15}$—) were used, specifically sulfonic acid for No. 3, carboxylic acid for No. 4 and phosphonic acid for No. 5. The tests were each conducted at a temperature of 95° C. and a surfactant concentration of 1 g/l. The treatment time was in each case about 15 h, and the solution was not conducted over ion exchangers during the treatment.

TABLE 1

Gamma radiation measurement of Am-241 as the indicator nuclide

| | Activity by alpha measurement [Bq/cm$^2$] | | | Gamma act. [Bq/cm$^2$] | Activity by alpha measurement [%] | | | Gamma act. [%] |
|---|---|---|---|---|---|---|---|---|
| No. | Pu-240 | Am-241 | Cm-242 | Am-241 | Pu-240 | Am-241 | Cm-242 | Am-241 |
| 1 | 0.771 | 5.43 | 0.6 | 4.58 | 100 | 100 | 100 | 100 |
| 2 | 0.079 | 0.425 | 0.03 | 0.413 | 10.2 | 7.83 | 5.02 | 9.02 |
| 3 | 0.056 | 0.264 | 0.019 | 0.308 | 7.21 | 4.86 | 3.13 | 6.73 |
| 4 | 0.01 | 0.042 | 0.003 | 0.033 | 1.28 | 0.78 | 0.51 | 0.73 |
| 5 | 0.001 | 0.003 | 0.0001 | 0.003 | 0.08 | 0.05 | 0.02 | 0.06 |

The minimum temperature for the effectiveness of the active ingredient component or of a surfactant which forms the latter from the group of sulfonic acid, phosphonic acid and carboxylic acid depends, inter alia, on the structure (for example length) of the nonpolar portion of the surfactant and is determined by what is called the "Krafft temperature." Below this temperature, the interactions between nonpolar portions cannot be overcome. The active ingredient remains as an aggregate in solution. In the case of the use of octadecylphosphonic acid as the active ingredient component, the minimum temperature for effective action is, for example, 75° C. The upper limit generally depends on process technology parameters. It is generally undesirable, for example, for the treatment solution to boil. A customary use temperature of decontamination treatments under atmospheric pressure is consequently, for example, 80-95° C. or 90-95° C.

Optimal Polar Functional Group:

The efficacy of the surfactants proposed also depends on the nature of the polar portion thereof. Even though, from a structural standpoint, the different active ingredient components proposed are comparable (they possess a nonpolar portion through which they interact with one another, and a polar portion through which the molecules of the active ingredient are repelled in a localized manner with respect to one another, and through which the interaction of the active ingredient with polar, charged or ionized particles or surfaces is enabled), there are differences between different functional groups in the chemical properties which are responsible for a different effect, including in the context of the decontamination in question in this case. These differences can be found by comparing a selection of active ingredient components which possess different polar functional groups but identical nonpolar portions. In the tests conducted for this purpose, other test conditions such as nature of the oxide layer to be detached, treatment temperature, pH, concentration of the active ingredient component and treatment time, were kept constant. Before the treatment, the samples were treated with 3 cycles of a decontamination process customary for nuclear power plants (for example with a complexing organic acid such as oxalic acid). Table 2, which reflects the results of the tests, reports not only the activity but also the decontamination factor (DF), i.e. the quotient of initial and final activity, which allows an estimate of the decontamination efficacy. It becomes clear from the results in Table 2 that a phosphonic acid with the formula $R—PO_3H_2$ (where $R=CH_3(CH_2)_{15}$) is the best suited to the removal of the alpha-radiating contamination under the same conditions.

TABLE 2

Best polar functional group:

| Polar group | Am-241 activity [Bq/cm$^2$] before | after | DF |
|---|---|---|---|
| carboxylic acid *) | 3.08 | 0.19 | 16.3 |
| sulfonic acid *) | 3.68 | 0.45 | 8.2 |
| phosphonic acid *) | 3.59 | 0.12 | 30.7 |
| sulfate | 2.30 | 0.19 | 12.1 |

*) with $CH_3—(CH_2)_{15}—$ radical

The effectiveness of the active component is determined not only by the polar portion thereof, but also by the nonpolar portion thereof, especially by the length or chain length thereof. The size or length of the nonpolar portions influences the interactions between the surfactant molecules due to van der Waals forces, larger nonpolar portions causing greater interactive forces with comparable structure. In the case of the formation of double layers on charged surfaces, this has the consequence, for example, that more molecules can be accommodated in the second layer, which is not in contact with the surface, in the double layer. This increases the charge density in this layer, which leads to higher interactions with water and higher coulombic repulsion forces. This promotes the mobilization of the activity. In the tests conducted for this purpose, the same conditions (nature of the oxide layer present on the samples, treatment temperature, pH, concentration of the active ingredient component and treatment time) were observed in each case. The result of these tests is evident from Table 3. This shows a comparison between the average decontamination efficacy of different active ingredient components with the same functional group in each case (phosphonic acid group) and different nonpolar radicals (C14: $CH_3—(CH_2)_{13}—$; C16: $CH_3—(CH_2)_{15}—$; C18: $CH_3—(CH_2)_{17}—$). Before the treatment, the samples were treated with 3 cycles of a decontamination process customary for nuclear power plants (see above). In addition to activity data, the customary decontamination factor (DF) is likewise reported, which simplifies an estimate of the decontamination efficacy.

TABLE 3

Best size of the nonpolar component:

| | With C14-PO3H2 Am-241 [Bq/cm$^2$] | σ | With C16-PO3H2 Am-241 [Bq/cm$^2$] | σ | With C18-PO3H2 Am-241 [Bq/cm$^2$] | σ |
|---|---|---|---|---|---|---|
| Before | 6.09 | 0.79 | 6.11 | 2.66 | 6.79 | 9.43 |
| After | 0.28 | 1.53 | 0.15 | 0.02 | 0.07 | 0.09 |
| DF | 21.9 | | 41.8 | | 102.0 | |

In order to determine the optimal pH range for the performance of the decontamination, four samples were treated in parallel, in each case under the same test conditions such as temperature, active ingredient concentration or exposure time, except for the pH. This was reduced in test No. 1 by adding $HNO_3$, left in No. 2 at the intrinsic equilibrium pH of the phosphonic acid active ingredient used, alkalized weakly in No. 3 by adding NaOH solution, and alkalized strongly in No. 4 by adding greater amounts of NaOH. As shown in Table 4, the best results are obtained in the case of neutralization of the phosphonic acid group (No. 3). In this medium, the group is doubly ionized as $R—PO_3^{2-}$, in contrast to the normal state ($R—PO_3H^-$). At acidic pH (No. 1), the dissociation of the acid group is inhibited by the increased concentration of $H_3O^+$ ions in the water. The active ingredient cannot maintain its required charged state. In the case of a strongly alkaline solution, the acid group is completely dissociated, and thus has maximum charge.

TABLE 4

Optimal pH range

| No. | pH | Am-241 [Bq/cm$^2$] Before | After | DF |
|---|---|---|---|---|
| 1 | 1.5 | 3.75 | 2.25 | 1.7 |
| 2 | 4.25 | 4.63 | 0.46 | 10.1 |
| 3 | 6 | 6.15 | 0.37 | 16.8 |
| 4 | 12 | 3.73 | 3.36 | 1.1 |

The process according to the invention is preferably used for the decontamination of components of the coolant system of a nuclear power plant (see appended FIG. 1). During operation, a more or less thick oxide layer forms on the surfaces of such components and, as has already been mentioned at the outset, is radioactively contaminated. First, the oxide layer is removed as far as possible. The component surfaces are then treated with a solution which includes at least one anionic surfactant from the group of sulfonic acids, phosphonic acids, carboxylic acids and salts thereof. It should be particularly emphasized that no further chemical additives are required apart from the surfactant, i.e. preference is given to working with an aqueous solution which includes exclusively at least one surfactant from the group mentioned. Since no further substances are present apart from the surfactant, the disposal of the surfactant solution is simple. As far as the particles which have been detached from the component surfaces and have passed into the surfactant solution are concerned, it was surprising that they can be removed from the solution with the aid of an anion exchanger or of a mixed bed ion exchanger, i.e. a combination of anion and cation exchanger. After single or repeated passage of the surfactant solution through an ion exchanger, virtually only water is then present, which can be disposed of in a customary manner with a low level of complexity.

The second treatment stage is performed at a temperature above room temperature, i.e. above about 25° C., although preference is given to working below 100° C. in order to reduce evaporation and hence water loss. Preference is given to working at temperatures of more than 50° C., with the best results being achieved at temperatures of more than 80° C.

The pH of the treatment solution in the second treatment stage is variable in principle. For instance, it is conceivable to accept that pH which results from the surfactant present in the solution. If the surfactant is an acid, a pH in the acidic range will be established. The best results, especially in the case of use of a phosphonic acid derivative as a surfactant, are achieved within a pH range from 3 to 9.

The concentration of the active component, i.e. of a surfactant of the type in question, in the second treatment solution is 0.1 g/l to 10 g/l. Below 0.1 g/l, no reduction in the alpha contamination of the component surface to a significant degree takes place. Above 10 g/l, barely any rise in the decontamination factor can be observed, and so concentrations exceeding the value mentioned have virtually no effect. A very good compromise between the amount of surfactant used and the decontamination effectiveness is achieved at surfactant concentrations up to 3 g/l.

In order to perform the second treatment stage, it is conceivable in principle to remove the spent cleaning solution present after the first treatment solution and to replace it with the second treatment solution, i.e., for example, in the case of decontamination of the coolant system of a nuclear power plant, to empty the latter and then fill it again with the second treatment solution. In the preferred procedure, however, the first treatment solution is substantially freed of the substances present therein, i.e. of a decontamination acid which serves the purpose of detaching the oxide layer present on a component surface, and metal ions originating from the oxide layer. In order to remove the decontamination acid, for example oxalic acid or the like, organic acids, the treatment solution is irradiated with UV light, which decomposes the acid to carbon dioxide and water. The metal ions present in the spent decontamination solution are removed by conducting the solution over an ion exchanger.

Other features which are considered as characteristic for the invention are set forth in the appended claims.

Although the invention is illustrated and described herein as embodied in a process for decontaminating radioactively contaminated surfaces, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWING

The FIGURE of the drawing is a diagrammatic, longitudinal-sectional view of a coolant system of a boiling water reactor.

DETAILED DESCRIPTION OF THE INVENTION

Referring now in detail to the single FIGURE of the drawing, there is seen a diagrammatic and schematic illustration of a coolant system of a boiling water reactor. The coolant system includes, in addition to a pressure vessel 1 in which a multiplicity of fuel assemblies 2 are present at least during operation, a conduit system 3 attached to the pressure vessel 1 through stubs 4, 5 and various internals, for example condensers. These internals are symbolized in their entirety by a box 6 in the FIGURE. In order to perform a first treatment stage, in the case of a decontamination of the entire coolant system, the latter is filled with a treatment solution which includes, for example, a complex-forming organic acid. In general, such a decontamination step is preceded by an oxidation step in order to oxidize chromium(III) present in an oxide layer disposed on inner surfaces 7 of the components to chromium(VI), as already mentioned. In the case of a complete decontamination, the entire cooling system is filled, whereas otherwise, only parts, for example only a section of the conduit system, can be treated.

After the spent solution present in the system has been cleaned in the manner described above, i.e. the decontamination acid present therein has been destroyed and metal ions have been removed with the aid of an ion exchanger, a surfactant, preferably phosphonic acid or phosphonic salt, is metered into the treatment solution which is thus formed and the second treatment stage is performed.

The invention claimed is:

1. A process for chemically decontaminating a surface of a metallic component, the process comprising the following steps:

in a first treatment stage, detaching an oxide layer from a component surface with a first aqueous treatment solution containing an organic decontamination acid, the oxide layer having been formed on the component as a result of corrosion of component material, the component surface being metallic components of a nuclear plant cooling system; and in a subsequent, second treatment stage, treating the component surface having been at least partly freed of the oxide layer with a second aqueous treatment solution containing an active component to remove particles adhering on the component surface, the active component being formed of at least one anionic surfactant selected from the group consisting of sulfonic acids, phosphonic acids, carboxylic acids and salts of these acids, the second treatment stage including conducting the second aqueous treatment solution over an ion exchanger no later than after an end of the second treatment stage.

2. The process according to claim 1, which further comprises selecting the surfactants as those having an organic radical with 12 to 22 carbon atoms.

3. The process according to claim 2, which further comprises selecting the surfactants as those having an organic radical with 14 to 18 carbon atoms.

4. The process according to claim 1, which further comprises performing the second treatment stage at a temperature of from 25° C. to less than 100° C.

5. The process according to claim 4, which further comprises performing the second treatment stage at a treatment temperature of more than 50° C.

6. The process according to claim 4, which further comprises performing the second treatment stage at a treatment temperature of more than 80° C.

7. The process according to claim 4, which further comprises performing the second treatment stage at a treatment temperature of at most 95° C.

8. The process according to claim 1, which further comprises, during the second treatment stage, maintaining a pH resulting from a presence of at least one surfactant in the second aqueous treatment solution.

9. The process according to claim 1, which further comprises altering a pH resulting from a presence of at least one surfactant in the second aqueous treatment solution.

10. The process according to claim 9, which further comprises increasing the pH in the altering step.

11. The process according to claim 1, which further comprises establishing a pH of from 3 to 9 in the second aqueous treatment solution.

12. The process according to claim 11, which further comprises establishing a pH of from 6 to 8 in the second aqueous treatment solution.

13. The process according to claim 1, which further comprises providing the active component with a concentration of 0.1 g/l to 10 g/l in the second aqueous treatment solution.

14. The process according to claim 13, which further comprises providing the active component with a concentration of 0.1 g/l to 3 g/l in the second aqueous treatment solution.

15. The process according to claim 1, which further comprises adding no further chemical substances apart from at least one surfactant and optionally an alkalizing or acidifying agent to the second aqueous treatment solution.

16. The process according to claim 1, which further comprises obtaining the second aqueous treatment solution from the first aqueous treatment solution by removing at least one or more than one decontamination acid, serving to detach the oxide layer present on a component surface, from the first aqueous treatment solution.

17. The process according to claim 16, which further comprises irradiating the first aqueous treatment solution with UV light to decompose a decontamination acid to carbon dioxide and water.

18. The process according to claim 16, which further comprises conducting the first aqueous treatment solution through at least one ion exchanger to remove metal ions present therein.

19. The process according to claim 1, wherein the first or second aqueous treatment solution is present in a vessel and a component to be treated is immersed into the respective solution.

20. The process according to claim 1, which further comprises providing an inner surface of a vessel and/or of a pipeline system as the component surface to be treated, and filling the vessel or pipeline system with the first or second aqueous treatment solution.

21. The process according to claim 20, which further comprises providing a coolant system of a nuclear power plant as the vessel and/or pipeline system.

* * * * *